United States Patent [19]

Di Marco et al.

[11] 4,087,769

[45] May 2, 1978

[54] TORSION SPRING FOR CONTACT PRESSURE

[75] Inventors: Bernard Di Marco; Keith T. Krueger, both of Bellefontaine, Ohio

[73] Assignee: I-T-E Imperial Corporation, Spring House, Pa.

[21] Appl. No.: 681,250

[22] Filed: Apr. 28, 1976

[51] Int. Cl.[2] ..... H01H 77/02

[52] U.S. Cl. ..... 335/16; 335/8

[58] Field of Search ..... 335/16, 195, 147, 8, 335/9, 10

[56] References Cited

U.S. PATENT DOCUMENTS

| | | | |
|---|---|---|---|
| 3,192,344 | 6/1965 | Cole | 335/16 |
| 3,646,488 | 2/1972 | Iida | 335/16 |

*Primary Examiner*—Harold Broome

*Attorney, Agent, or Firm*—Ostrolenk, Faber, Gerb & Soffen

[57] ABSTRACT

A multipole circuit breaker is constructed with a single rod pivotally mounting all of the movable contact arms to a common one piece molded insulating carrier. Individual torsion springs engage each of the contact arms to provide contact pressure when the circuit breaker is closed. The construction of the contact arms and carrier are such that under severe overcurrent conditions electrodynamic blowoff forces acting on the contact arms may bring about contact separation that is substantially as great as the contact separation that takes place when the circuit breaker is opened normally by its contact operating mechanism.

12 Claims, 11 Drawing Figures

TORSION SPRING FOR CONTACT PRESSURE

This invention relates to multi-pole circuit breakers in general and more particularly relates to the means which mounts the movable contact arms and provides resilient contact pressure.

Some prior art circuit breakers have been constructed so that under severe short current conditions, prior to movement of the contact a spring-powered operating mechanism, electromagnetic blowoff forces cause contact separation. This contact blow-off has the effect of limiting current to a value that may be safely interrupted by the switch. A major problem which has been encountered in switches of this type is that there was limited contact separation resulting from electrodynamic blowoff effects, thereby restricting the effectiveness of the current limiting action. Apparently, this limitation of contact separation was due in part to the mechanical arrangement of the movable elements, and possibly to a greater extent to the compromise necessitated by high contact spring pressure and a spring pressure that would not unnecessarily inhibit contact separation resulting from electrodynamic effects.

In accordance with the instant invention, the foregoing problems are solved by providing a multipole circuit breaker having a transverse tie bar or carrier to which the movable contacts of all poles are mounted. This mounting is achieved by a rod that extends through aligned apertures in the carrier and contact arms, and is positioned along the pivot axis for said carrier. An individual torsion spring for each of the contact arms provides contact pressure when the switch is closed. Each torsion spring is wound upon the rod and is constructed so that loading of each contact arm by its spring does not increase substantially as the contact arm moves relative to the carrier as result of electrodynamic blowoff effects. Assembly of the contact arms and springs to the carrier is simplified in that the carrier is a single piece unit constructed of plastic and the rod is the sole element for mounting the contact arms and springs to the carrier and retaining all of the elements in their operative positions.

Accordingly, a primary object of the instant invention is to provide a novel construction for a movable contact subassembly of a multipole circuit breaker.

Another object is to provide a subassembly of this type constructed so that contact separation due to electrodynamic effects is substantially as great as contact separation resulting from a spring powered operating mechanism for the subassembly.

Still another object is to provide a subassembly of this type in which torsion springs are utilized to provide contact pressure when the switch is closed.

A further object is to provide a subassembly of this type in which the contact arms are pivotally mounted on the contact carrier by a single rod that extends along the pivot axis for the carrier.

A still further object is to provide a subassembly of this type in which a single rod is the sole means for mounting a plurality of contact arms and their individual contact pressure springs to a one-piece molded insulating carrier.

These objects as well as other objects of this invention shall become readily apparent after reading the following description of the accompanying drawings in which.

Figure 4:
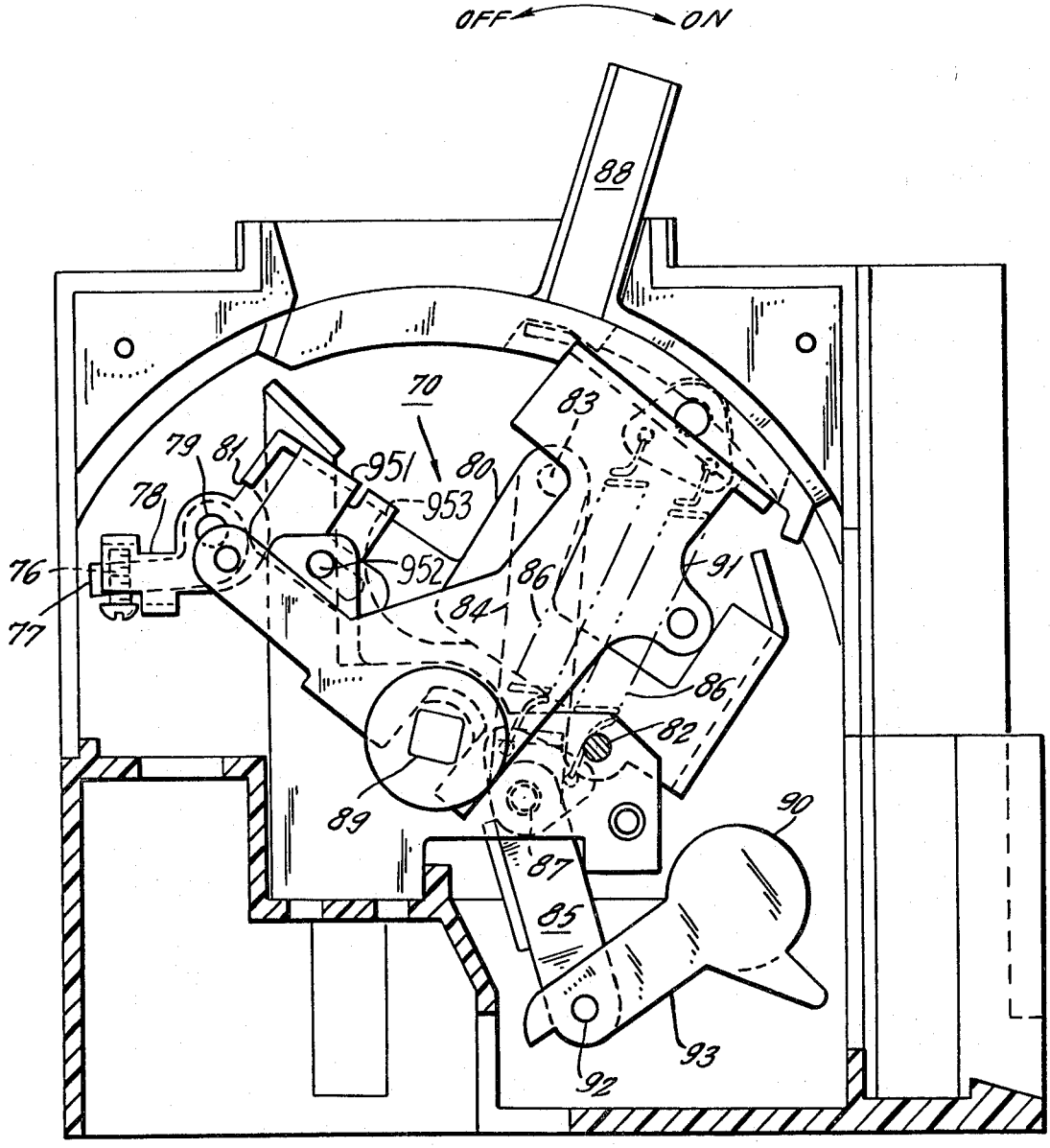
FIG. 4 is a cross-section taken through line 4—4 of FIG. 1 looking in the direction of arrows 4—4 and showing the elements of the manual operating mechanism for the circuit breaker portion.

Now referring to the Figures. Unitized Combination motor starter 20 includes a molded insulating housing consisting of base 21 and removable shallow front cover 22 secured in operative position by screws 19. Cover 22 includes longitudinally extending parallel ribs that mate with similar ribs 24, 25, 26 in base 21 to form elongated parallel compartments. Three of these compartments have current carrying elements identical to those illustrated in the right hand portion of FIG. 2, and constitute a pole of the three pole circuit breaker portion 59 of starter 20. Removable side cover 67 is provided for the compartment which encloses spring powered trip free contact operating mechanism 70 of FIG. 4.

Figure 2:
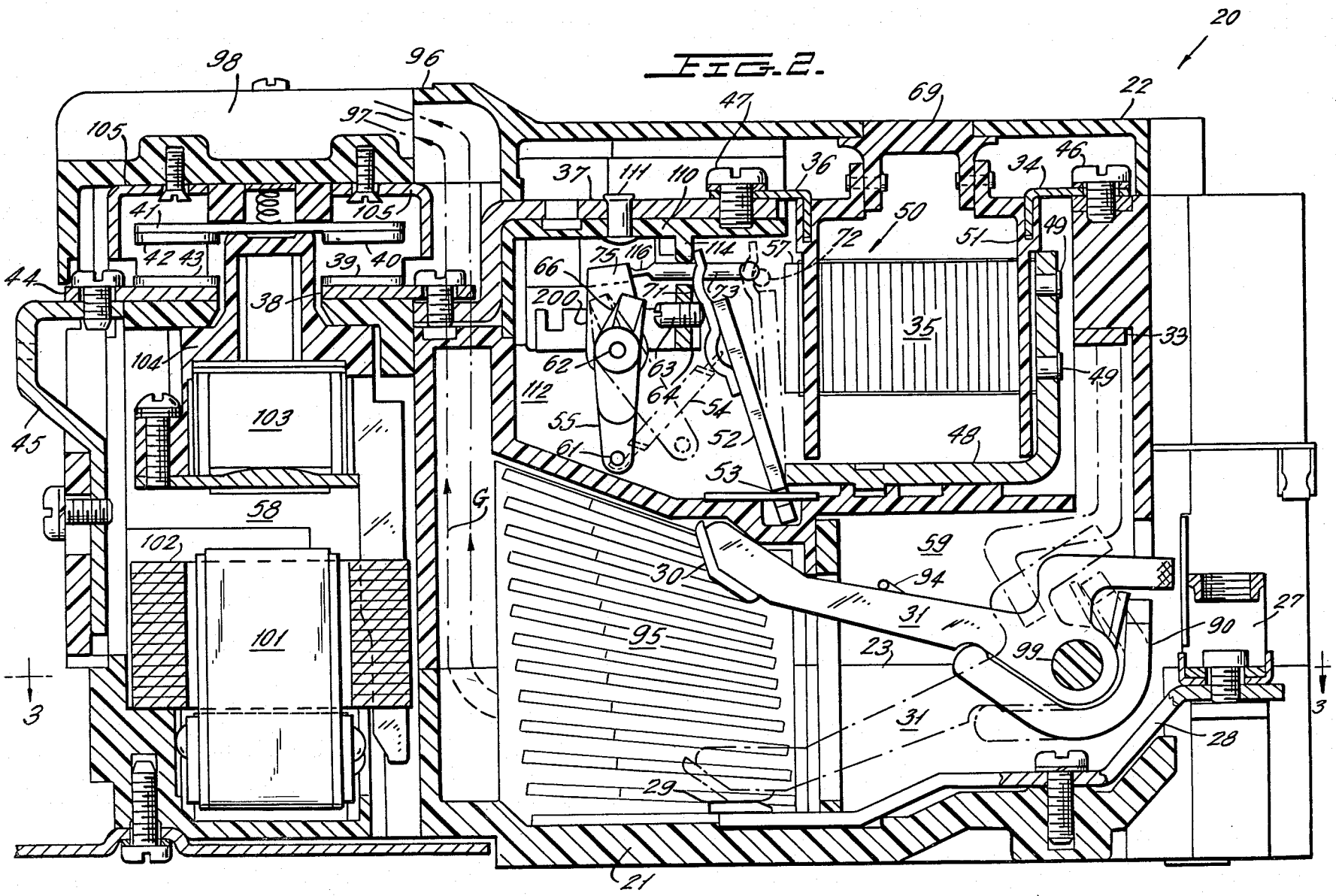
FIG. 2 is a cross-section taken through line 2—2 of FIG. 1 looking in the direction of arrows 2—2 and showing the elements of one pole unit.
Figure 3:
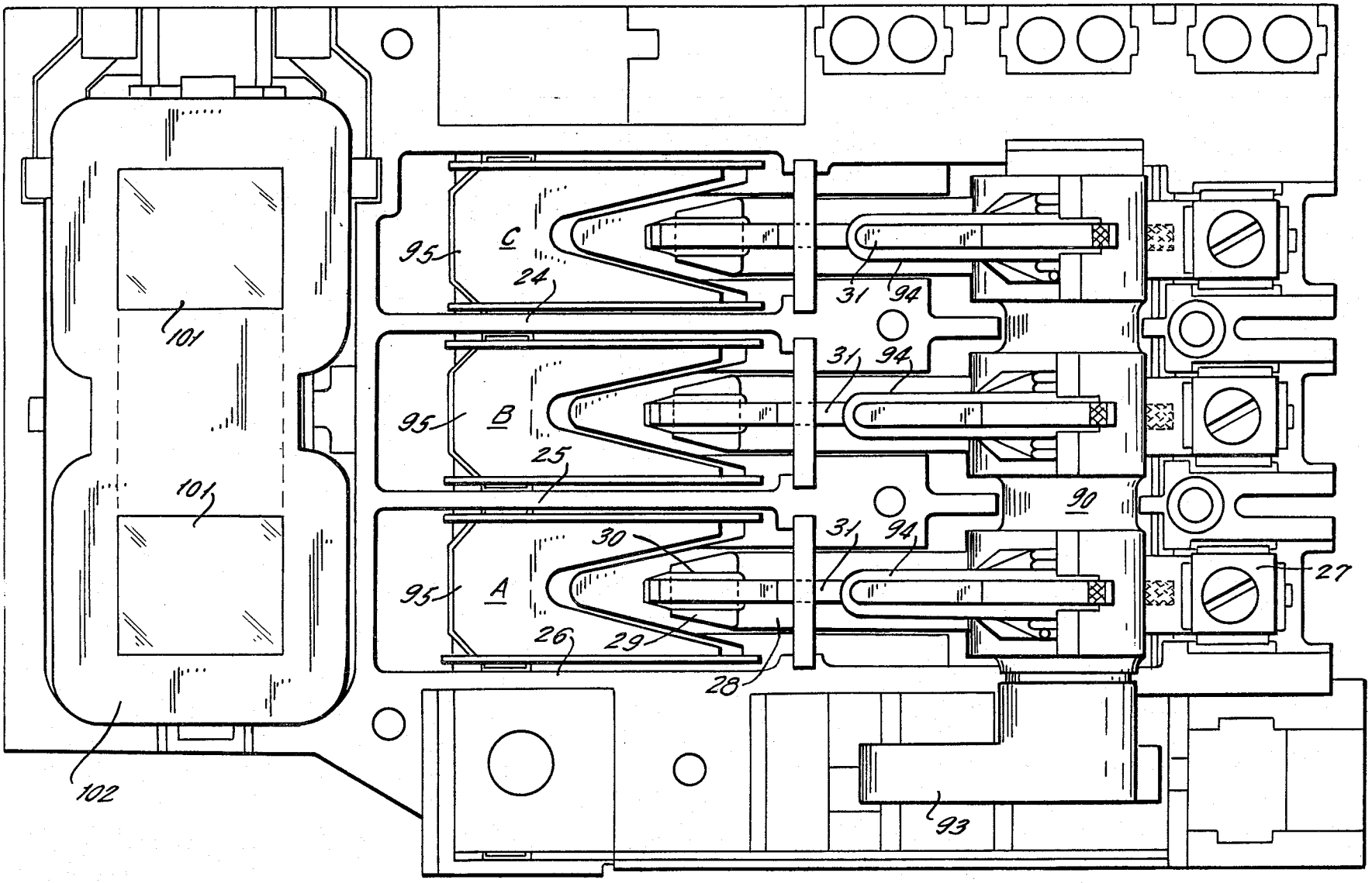
FIG. 3 is a cross-section taken through lines 3—3 of FIG. 2 looking in the direction of arrows 3—3.

The current carrying path for each pole A, B, C of starter 20 is identical so that only one of these paths shall be described with particular reference to FIG. 2. This current path includes wire grip 27 at one end of line terminal strap 28, strap 28, stationary contact 29 at the other end of strap 28, movable contact 30 at one end of movable contact arm 31, arm 31, flexible braid 32 at the other end of arm 31, U-shaped strap 33, coil terminal 34, coil 35, the other terminal 36 for coil 35, conducting straps 37 and 38, stationary contact 39 of electromagnetic contactor portion 58 of starter 20, movable contactor contact 40, conducting bridge 41, movable contactor contact 42, stationary contactor contact 43, conducting strap 44, and load terminal strap 45. The latter is constructed so as to be connectible directly to a load or to be connectible to a load through a conventional overload relay (not shown).

Figure 1:
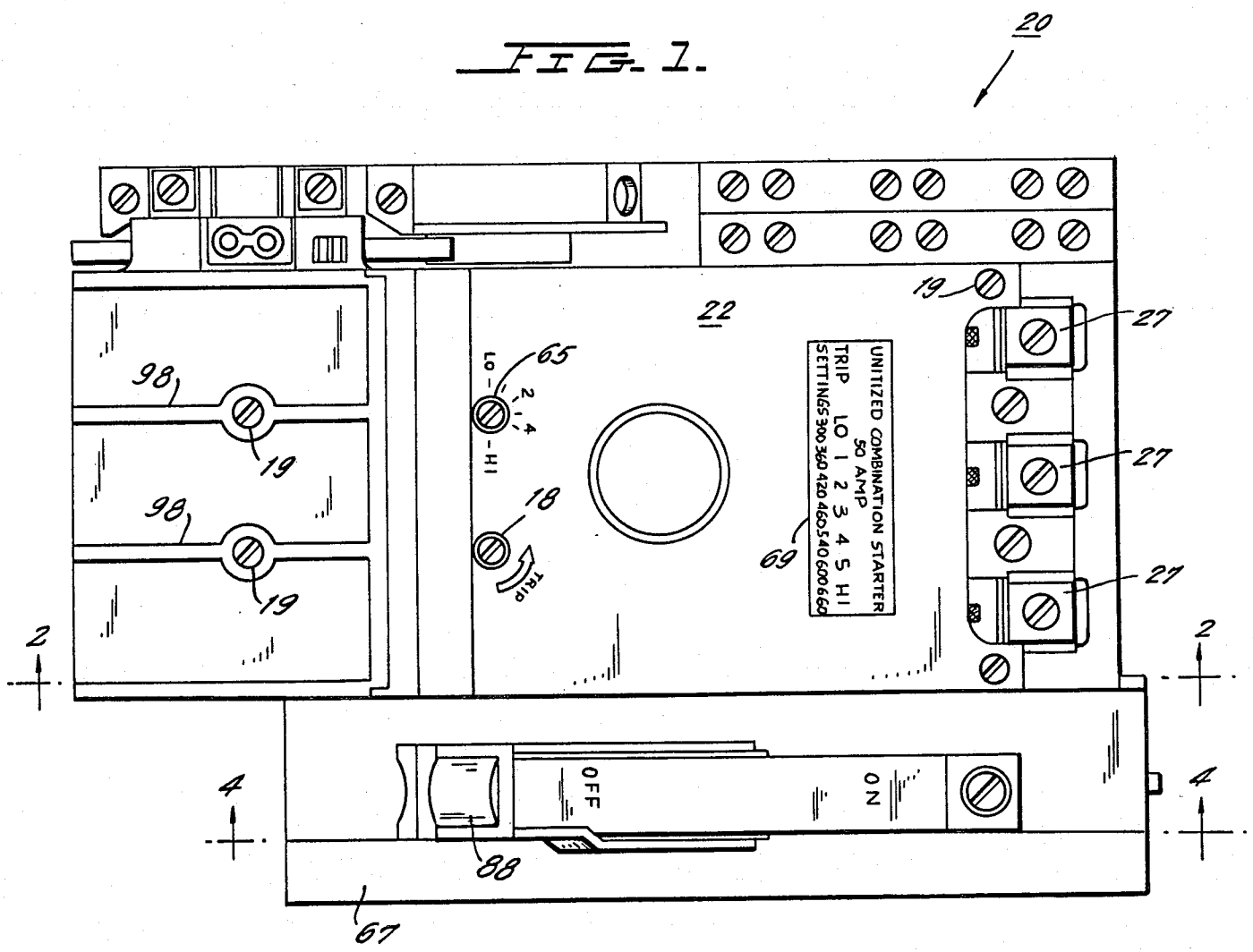
FIG. 1 is a plan view of a unitized combination motor starter including trip bar means constructed in accordance with teachings of the instant invention.

Coil 35 is part of circuit breaker calibrating assembly 50 removable and replaceable from the front of starter 20 after front cover 21 is removed. The calibrating assemblies 50 of all three poles may be individual units or they may be connected to a common insulating member 69 (FIG. 1) so that all three assemblies 50 must be removed as a unit.

Each subassembly 50 is electrically and mechanically secured in operative position by a pair of screws 46, 47 that are accessible when cover 22 is removed from base 21. Coil 35 is wound about bobbin 57 that surrounds one leg of stationary C-shaped magnetic frame 48. The latter is secured by rivets 49, 49 to insulator 51 having terminal 34 and bobbin 57 mounted thereto. The magnetic frame also includes movable armature 52 which is pivotally mounted at its lower end in the region indicated by reference numeral 53 so that the upper end of armature 52 may move toward and away from stationary frame portion 48. Coiled tension spring 54 is connected to pin formation 61 at the edge of radial adjusting bar 55 remote from its pivot provided by pins 62. Thus, spring 54 biases the forward end of armature 52 away from magnetic frame 48.

Figure 5:
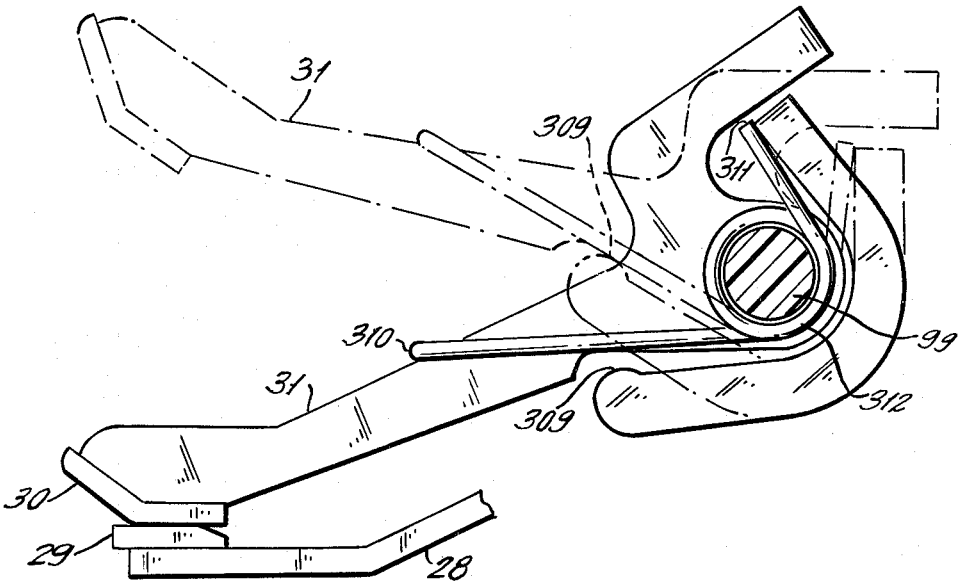
FIG. 5 is a fragmentary view showing the contacts of one pole in both the normally open and normally closed positions.

The air gap adjustment between armature 52 and frame 48 is set by screw 63 which is threadably mounted to transverse member 64. A cam (not shown) at the rear of pivotable adjusting control 65 engages extension 66 of member 55 to adjust the tension on all three springs 54 without changing the air gaps between any of the armatures 52 and their associated stationary frame sections 48. Control 65 extends through and is journalled for movement within aperture **65*a* of auxiliary cover 110 (FIG. 5). Turn-to-trip control 18 extends through and is journalled for movement within aperture 18*a* of auxiliary cover 110. Both controls 65 and 18 are accessible for operation through apertures in main cover 22**.

Upon the occurrence of predetermined fault current conditions the flux generated by current flowing in coil 35 attracts armature 52 to stationary frame 48 causing bifurcated armature bracket 71 to engage enlarged formation 72 on transverse extension 73 of common tripper bar 75. The latter is part of tripper bar means 200 that pivots clockwise about an axis which coincides with axis 62 for adjusting bar 55 which causes screw 76 on tripper bar extension 77 to pivot latch member 78 in a clockwise or tripping direction about its pivot 79, thereby releasing latching point 81 of latch plate 951 on pivot 952 thereby releasing latching point 953 of cradle 80 so that the latter is free to pivot clockwise about pivot 82. As cradle 80 pivots clockwise, end 83 of upper toggle link 84 moves up and to the right with respect to FIG. 4 permitting coiled tension springs 86, connected between toggle knee 87 and manual operating handle 88 collapse toggle 84, 85 and move handle 88 to the left. The latter is pivoted about center 89 through a connection between handle 88 and its rearward extension 91.

The lower end of lower toggle link 85 is pivotally connected at 92 to the free end of radial extension 93 of contact carrier 90. Hereinafter, the latter element shall be described in greater detail. Thus, as toggle 84, 85 collapses carrier 90 is pivoted clockwise with respect to FIG. 4 and by so doing moves the contact arms 31 of all three poles to the solid line or open circuit position of FIG. 2. It is noted that base 21 is a multipart unit having sections which mate along dividing line 23 so that the reduced diameter bearing portions of contact carrier 90 may be inserted and captured in operative positions. In the closed position of circuit breaker portion 59 a individual torsion spring 94, interposed between carrier 90 and movable contact arm 31, biases arm 31 counterclockwise about insulating rod 99 as a center and thereby generates contact pressure.

For each pole A, B, C an individual parallel plate arc chute 95 is provided to facilitate extinction of arcs drawn between circuit breaker contacts 29, 30 upon separation thereof. Arcing gases exiting from arc chute 95 at the left thereof with respect to FIG. 2 migrate forward as indicated by the dash lines G and are directed by hooded portion 96 of cover 22 to exit through opening 97 and flow to the left with respect to FIG. 2 in front of contactor section 58. External cover barriers 98 serve to prevent direct mixing of arcing gases from different poles at the instant these gases leave housing 21, 22 through exit openings 97.

The electrical and magnetic elements of contactor 58 are generally of conventional construction and include U-shaped magnetic yoke 101 whose arms are surrounded by portions of coils 102. When the latter is energized, armature 103 is attracted to yoke 101 and carries contact carrier 104 rearward. The latter mounts the bridging contacts 41 of all three poles so that contacts 41 move to their closed position wherein movable contacts 40, 42 engage the respective stationary contacts 39, 43. Steel elements 105 mounted to the inside of cover 22 are positioned in the regions of the contactor contacts 39, 40, 42, 43 whereby extinction of arcs drawn between these contacts upon separation thereof is facilitated through magnetic action.

Rivet III (FIG. 2) secures conducting strap 37 on the forward surface of insulating cover 110 of L-shaped cross-section. The latter forms the forward boundary for chamber 112 wherein common tripper bar 75, adjusting bar 55 and armatures 52 are disposed. After the removal of main cover 22, auxiliary cover 110 is removable for access to adjusting screws 63. The rear surface of cover 110 is provided with protrusions 114 which engage and guide movement of extension 73. The latter is flexibly mounted to trip bar 75 at resilient reduced cross-section area 116 which is constructed to bias extension 73 forward.

Figure 7:
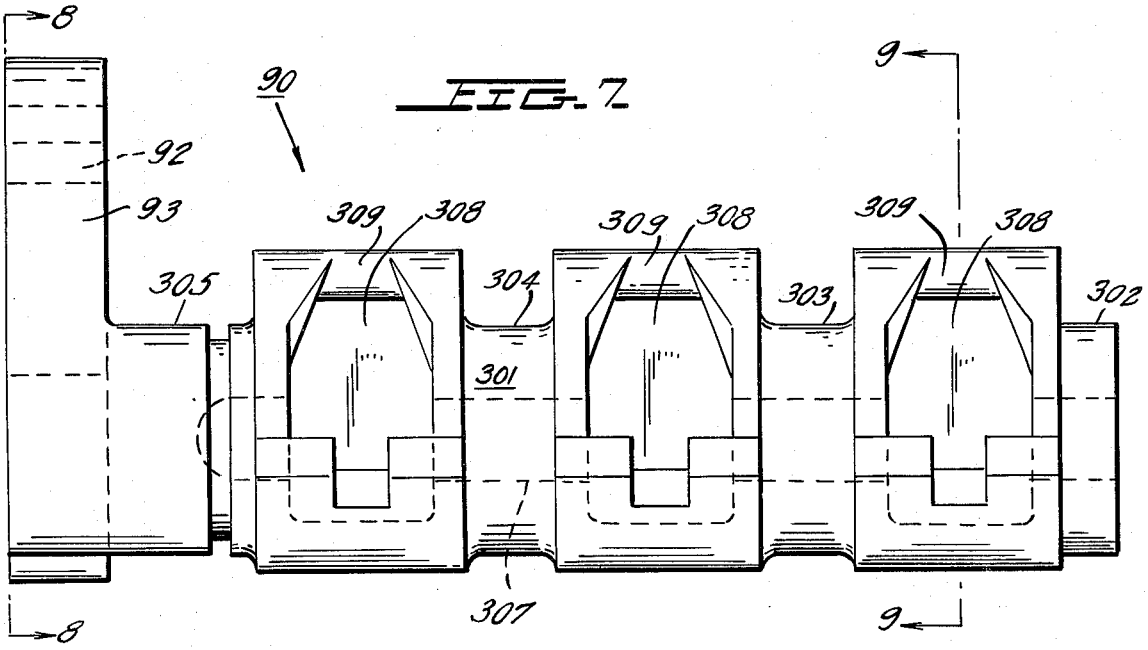
FIG. 7 is a plan view of the one piece contact carrier.
Figure 8:
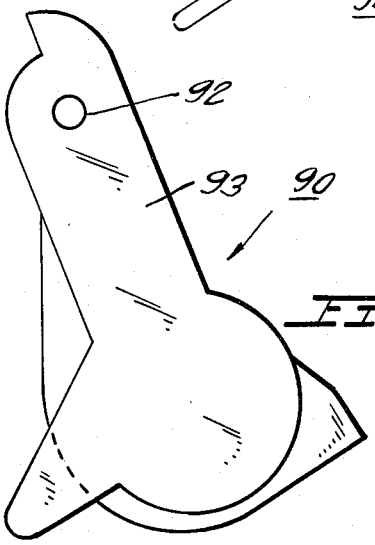
FIG. 8 is an end view of a contact carrier looking in the direction of arrows 8—8 of FIG. 7.
Figure 9:
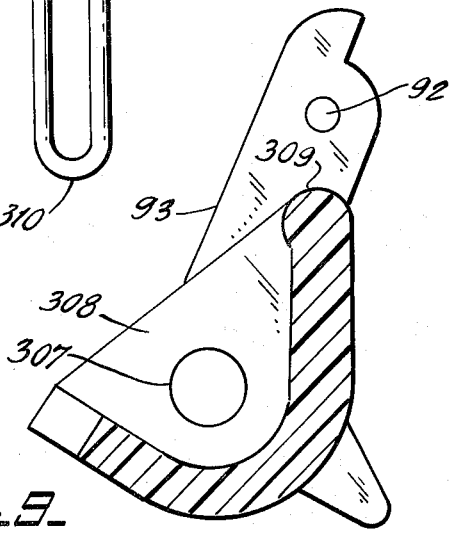
FIG. 9 is a cross-section taken through line 9—9 of FIG. 7 looking in the direction of arrows 9—9.

Contact carrier 90, shown in detail in FIGS. 7 through 9, is a one piece unit molded of plastic material and includes a main elongated section 301 which extends transverse to contact arms 31 through the housing compartments for all three poles of circuit breaker portion 59. Main section 301 is provided with four spaced bearing portions 302–305 which define a pivot axis for carrier 90. Radial extension 93 is disposed at one end of carrier 90 adjacent to bearing portion 305. Circular bore or aperture 307, positioned along the pivot axis for carrier 90, extends from the end of main section 301 opposite extension 93 to bearing 305.

Bearings 303 and 304 separate three identical pocket-like locating formations 308 formed in main section 301. The individual contact arms 31 are entered into individual ones of the pockets 308 and are pivotally mounted by insulating rod 99 which extends through bore 307 as well as through clearance apertures in each of the contact arms 31 at portions thereof disposed within pocket 308.

An individual torsion spring 94 (FIGS. 10 and 11) is provided for biasing each movable contact arm 31 toward pocket surface formation 309. Each spring 94 includes an elongated U-shaped central portion 310 which bears against the forward edge of contact arm 31. The ends 311 of spring 94 bear against the interior of pocket 308, and interposed between each end 311 and central portion 310 are a plurality of turns 312 which are coiled around rod 99. Each set of turns 312 is disposed adjacent a different side of contact arm 31 and both set of turns 312 are disposed within pocket 308.

Figure 6:
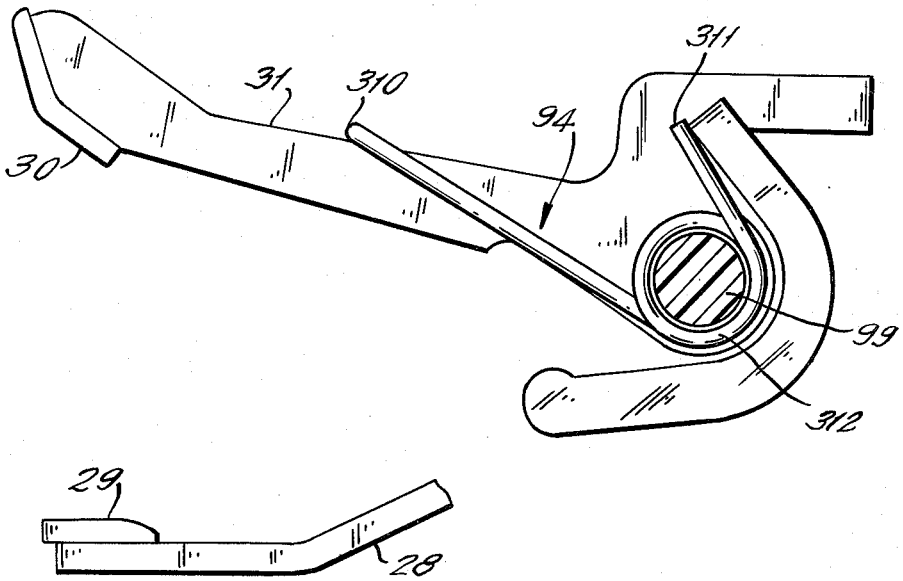
FIG. 6 is a view similar to FIG. 5 showing the movable contacts separated from the stationary contact by electrodynamic blowoff forces.
Figure 10:
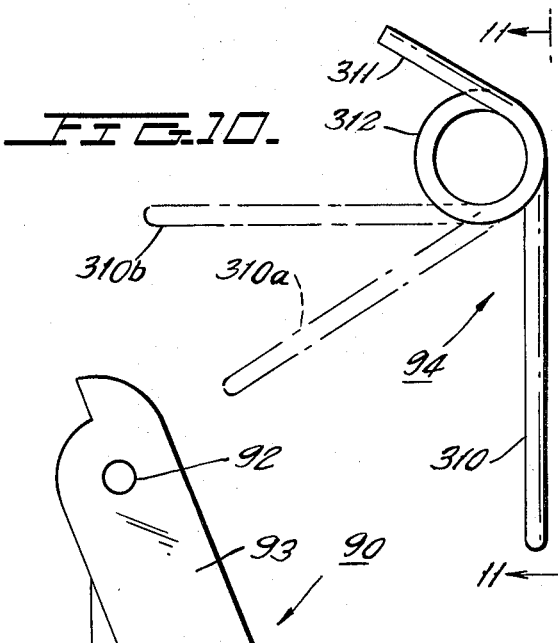
FIG. 10 is a side elevation of a contact pressure spring in its relaxed state.
Figure 11:
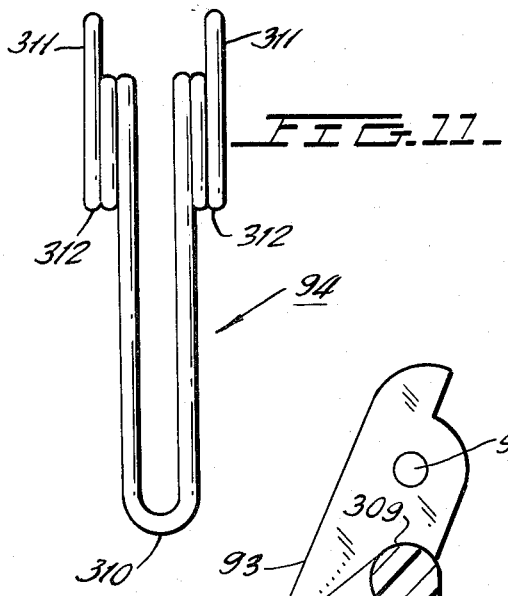
FIG. 11 is an elevation of the contact pressure spring looking in the direction of arrows 11—11 of FIG. 10.

With contact 31 in the open circuit position indicated in phantom FIG. 5 having been operated to this position by contact operating mechanism 70, contact arm 31 abuts surface 309 being held in this position by spring 94, which is in the solid line position indicated in FIG. 10. When contacts 29, 30 are engaged, as indicated in the solid line position of FIG. 5, contact arm 31 is spaced slightly from surface 309 so that spring 94 exerts pressure in a closing direction between contacts 29 and 30. Upon the occurrence of severe overload currents, strong electrodynamic blowoff forces are present in that currents flow in opposite directions in the relatively closely spaced contact arm 31 and line terminal strap 28. These electrodynamic forces are in a direction which causes contact arm 31 to pivot clockwise with respect to FIGS. 5 and 6 even before operating mechanism 70 has moved contact carrier 90 toward the open circuit position indicated in phantom in FIG. 5. These forces may be of sufficient strength so that separation between contacts 29, 30 is essentially the same as that separation obtained through operation of mechanism 70.

This large movement for contact arm 31 prior to open circuit movement of carrier 90 is permitted because of the configuration of contact 30 and contact arm 31, together with the construction of means connecting these two elements including torsion spring 94. In particular the multiple turns of the latter results in a structure which does not appreciably increase loading on contact arm 31 as central portion 310 of spring 94 moves from its normally loaded position 310*a* relative to ends 311 to its full blow-off position 310b relative to ends 311 (FIG. 10).

For more detailed descriptions of certain elements illustrated in the drawings reference is made to one or more of the following co-pending U.S. Pat. applications Ser. Nos. 681,243, 681,245, 681,253, 681,244, all filed on even date herewith.

Although a preferred embodiment of this invention has been described, many variations and modifications will now be apparent to those skilled in the art, and it is therefore preferred that the instant invention be limited not by the specific disclosure herein but only by the appending claims.

The embodiments of the invention in which an exclusive privilege or property is claimed are defined as follows:

1. A multipole switching device including for each pole thereof a relatively stationary contact; a movable contact engageable with said stationary contact and a contact arm having said movable contact on one end thereof; a contact operating means operatively connected to said arms for opening and closing said device; a carrier interposed between said movement thereof about a pivot axis by said operating means; said carrier including individual locating formations for each of said arms; first means at each of said locating formations pivotally mounting said arms at their outer ends to said carrier whereby each of said arms is independently and pivotally movable with respect to said carrier about an axis that is substantially coincident with said pivot axis; individual contact biasing means for each of said arms urging said movable contacts toward said stationary contacts; said biasing means being proportioned to permit substantial opening movement of said movable contacts under severe overload conditions solely as a result of electrodynamic forces prior to opening of said switching device by said operating means.

2. A multipole switching device as set forth in claim 1 in which the first means includes a rod extending through aligned apertures in said arms and said carrier.

3. A multipole switching device as set forth in claim 2 in which each of said biasing means is a torsion spring.

4. A multipole switching device as set forth in claim 3 in which each of said springs includes a portion wound around said rod.

5. A multipole switching device as set forth in claim 3 in which each of said springs includes end portions wound around said rod and positioned adjacent opposite sides of each of said arms.

6. A multipole switching device as set forth in claim 5 in which each of said springs includes an additional portion extending between said end portions and bearing against said arm.

7. A multipole switching device as set forth in claim 6 in which each of said locating formations defines a pocket through which said rod extends.

8. A multipole switching device as set forth in claim 7 in which each of said pockets includes an interior wall providing a bearing for one of said springs.

9. A multipole switching device as set forth in claim 7 in which each of said pockets includes a formation against which one of said arms bears when said switching device is opened by said operating mechanism.

10. A multipole switching device as set forth in claim 2 in which the carrier and the rod are each constructed of a single piece of insulating material.

11. A multipole switching device as set forth in claim 2 in which the rod extends along the pivot axis for the carrier.

12. A multipole switching device as set forth in claim 1 in which the carrier and biasing means are operatively constructed so that solely under the influence of said electromagnetic forces separation between said contacts may be substantially as great as separation between said contacts through opening of said switching device by said operating means.

* * * * *